US009499365B2

(12) United States Patent
Yamaoka et al.

(10) Patent No.: US 9,499,365 B2
(45) Date of Patent: Nov. 22, 2016

(54) SHEET FEEDING DEVICE AND IMAGE FORMING APPARATUS

(71) Applicant: CANON KABUSHIKI KAISHA, Tokyo (JP)

(72) Inventors: Takahiko Yamaoka, Kashiwa (JP); Shinnosuke Iwadate, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/593,780

(22) Filed: Jan. 9, 2015

(65) Prior Publication Data

US 2015/0197402 A1 Jul. 16, 2015

(30) Foreign Application Priority Data

Jan. 10, 2014 (JP) ..... 2014-003368

(51) Int. Cl.
*B65H 1/14* (2006.01)
*B65H 7/02* (2006.01)

(52) U.S. Cl.
CPC *B65H 7/02* (2013.01); *B65H 1/14* (2013.01); *B65H 2511/152* (2013.01); *B65H 2511/20* (2013.01); *B65H 2511/51* (2013.01); *B65H 2511/515* (2013.01); *B65H 2513/10* (2013.01); *B65H 2513/108* (2013.01)

(58) Field of Classification Search
CPC ..... B65H 1/025; B65H 1/14; B65H 1/18; B65H 2513/108; B65H 2511/152
See application file for complete search history.

(56) References Cited

U.S. PATENT DOCUMENTS

| | | | | |
|---|---|---|---|---|
| 3,558,127 | A * | 1/1971 | Blewitt, Jr. | B65H 1/14 271/155 |
| 5,295,678 | A * | 3/1994 | Lindner | B65H 1/18 271/152 |
| 5,507,224 | A * | 4/1996 | Cuff | B65H 1/14 101/232 |
| 5,556,252 | A * | 9/1996 | Kuster | B65H 1/14 271/155 |
| 9,254,973 | B2 * | 2/2016 | Ishida | B65H 1/18 |
| 9,296,574 | B2 * | 3/2016 | Taniguchi | B65H 1/08 |
| 2008/0001342 | A1 * | 1/2008 | Matsushima | B65H 1/14 271/3.14 |
| 2015/0183596 | A1 * | 7/2015 | Shimazu | B65H 1/14 271/153 |

FOREIGN PATENT DOCUMENTS

| | | | |
|---|---|---|---|
| JP | 2007-238312 A | | 9/2007 |
| JP | 2007238312 A | * | 9/2007 |

* cited by examiner

*Primary Examiner* — Jeremy R Severson
(74) *Attorney, Agent, or Firm* — Canon USA, Inc. IP Division

(57) ABSTRACT

A sheet feeding device includes a sheet storage unit, a driving unit, a first detection unit, a second detection unit, and a control unit. The sheet storage unit includes a tray on which a sheet bundle including a plurality of sheets is to be stacked. The driving unit lifts up the tray. The first detection unit detects, at a predetermined position, a top surface of the sheet bundle stacked on the tray and lifted up. The second detection unit detects whether a sheet is stacked on the tray. The control unit controls, while the first detection unit has not detected the top surface of the sheet bundle, the driving unit to lift up the tray at a first speed until the second detection unit detects the sheet, and to lift up the tray at a second speed lower than the first speed after the second detection unit detects the sheet.

9 Claims, 6 Drawing Sheets

WITH SHEET

WITHOUT SHEET

SHEET FEEDING DEVICE AND IMAGE FORMING APPARATUS

BACKGROUND OF THE INVENTION

Field of the Invention

The present invention relates to a sheet feeding device for feeding stacked sheets, and an image forming apparatus including the sheet feeding device.

Description of the Related Art

An image forming apparatus such as a copying machine, a printer, and a facsimile includes a sheet feeding device in which a plurality of pieces of sheet-shaped recording paper (hereinafter, referred to as sheets) is stored. The image forming apparatus takes out and feeds the sheets one by one from the sheet feeding device to an image forming unit, and performs image formation on the sheets. The sheet feeding device includes a sheet feeding cassette (sheet feeding tray) for stacking a sheet bundle thereon. In the sheet feeding cassette, an elevating tray on which the sheet bundle is stacked is lifted up toward a sheet feeding roller by a spring or gear configuration. The sheet feeding roller makes press-contact with the top surface of the lifted sheet bundle and rotates to feed a sheet out of the sheet feeding cassette. If two sheets are simultaneously fed out by the sheet feeding roller, a separation roller separates the sheets and the upper sheet is conveyed to a conveyance path leading to the image forming unit.

In the sheet feeding cassette, the elevating tray generally descends when a user opens (pulls out) the sheet feeding cassette to replenish sheets. The reason is that sheets are not able to be replenished if the elevating tray or the sheets on the elevating tray are in press-contact with the sheet feeding roller. After the user replenishes sheets and closes (pushes in) the sheet feeding cassette, a lift-up operation is performed by which the elevating tray ascends toward the sheet feeding roller.

For example, a sheet feeding device discussed in Japanese Patent Application Laid-Open No. 2007-238312 includes a position sensor capable of detecting the position of sheets and an elevation tray inside. For example, when the sheet feeding device performs a lift-up operation of the sheets and the elevating tray, the elevating tray ascends at a first speed until the position sensor detects the ascent of the elevating tray to a predetermined position. After the position sensor detects that the elevating tray has reached the predetermined position, the elevating tray ascends at a second speed lower than the first speed. This reduces the time needed for the lift-up operation and improves sheet position accuracy at the completion of the lift-up operation.

Provision of the dedicated sensor for detecting the timing to switch the lift-up speed leads to increased costs. The sensor for detecting the timing to switch the speed may be omitted for the sake of cost reduction. In such a case, however, the time to complete the lift-up operation increases and usability decreases if the lift-up speed is low. If the lift-up speed is uniformly increased, variations in sheet position at the completion of the lift-up operation may increase, thereby reducing the stability of sheet feeding operations. More specifically, a sheet feeding pressure between a sheet and the sheet feeding roller that are in the press-contact state is extremely important to stably separate and convey sheets one by one from a sheet bundle. Variations in the sheet position make sheet feeding operations unstable.

SUMMARY OF THE INVENTION

The present invention is directed to a sheet feeding device and an image forming apparatus which can reduce lift-up time of an elevating tray and perform stable sheet feeding operations without including a dedicated sensor for determining the switching timing of the lift-up speed.

According to an aspect of the present invention, a sheet feeding device includes a sheet storage unit having a tray on which a sheet bundle including a plurality of sheets is to be stacked, a driving unit configured to lift up the tray, a first detection unit configured to detect, at a predetermined position, a top surface of the sheet bundle stacked on the tray lifted up by the driving unit, a second detection unit configured to detect whether a sheet is stacked on the tray, and a control unit configured to control, while the first detection unit has not detected the top surface of the sheet bundle, the driving unit to lift up the tray at a first speed until the second detection unit detects the sheet, and to lift up the tray at a second speed lower than the first speed after the second detection unit detects the sheet.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

<Overview of Image Forming Apparatus>

Figure 1:
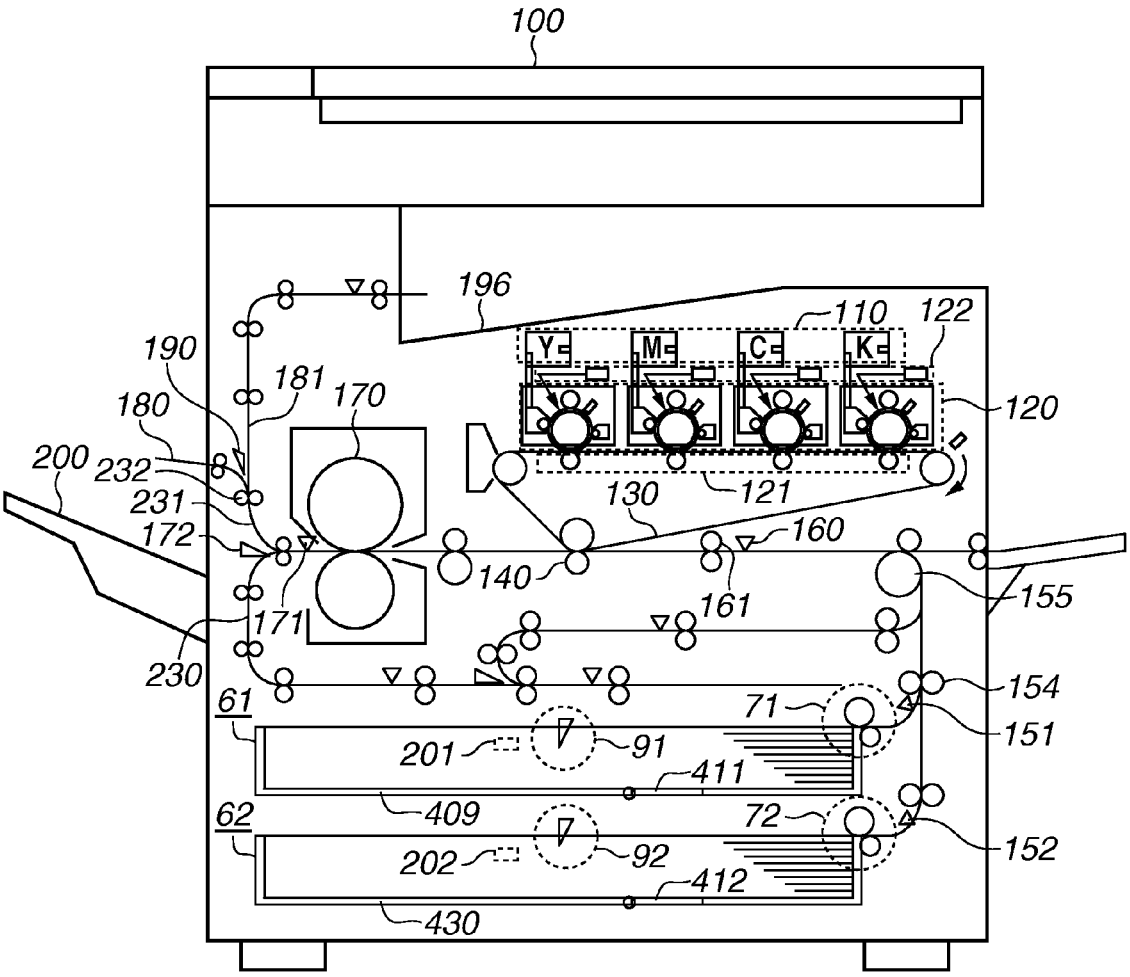
FIG. 1 is a schematic sectional view of an image forming apparatus.

FIG. 1 is a sectional view illustrating a configuration of an image forming apparatus as an example of an image forming apparatus according to an exemplary embodiment of the present invention. The configuration and an image forming operation of the image forming apparatus will be described with reference to FIG. 1.

In the image forming apparatus, a laser scanner unit 122 irradiates photosensitive drums in a process unit 120 with laser light according to an image of a document read by a reader 100. The process unit 120 includes four photosensitive drums, developing units, charging rollers, and photosensitive drum cleaners. The irradiating laser light forms electrostatic latent images on the photosensitive drums. More specifically, the charging rollers charge up the surfaces of the photosensitive drums, and then the laser light from the laser scanner unit 122 forms electrostatic latent images on the photosensitive drums. The formed electrostatic latent images are developed by toners (developers) in four colors (yellow (Y), magenta (M), cyan (C), and black (K)) in a developer unit 110, whereby toner images are formed on the photosensitive drums. The toner images are transferred from the photosensitive drums onto a transfer belt 130 by applying a transfer voltage to a primary transfer unit 121. The transfer belt 130 rotates in the direction of the arrow illustrated in FIG. 1, whereby the toner images transferred onto the transfer belt 130 are moved to a secondary transfer unit 140. The process unit 120, the primary transfer unit 121, the laser scanner unit 122, and the secondary transfer unit 140 constitute an image forming unit.

The image forming apparatus includes two sheet feeding devices 61 and 62. The sheet feeding device 61 includes a sheet presence/absence detection mechanism 91 (enclosed in a dotted-line circle), a sheet feeding mechanism 71 (enclosed in a dotted-line circle), and a pickup sensor 151. The sheet presence/absence detection mechanism 91 detects the presence or absence of sheets in a sheet feeding cassette 409. The sheet feeding mechanism 71 feeds and conveys the sheets in the sheet feeding cassette 409. The pickup sensor 151 monitors a sheet feeding operation. The sheet feeding device 61 further includes a lifter plate 411 that lifts up and down a tray 410 (see FIG. 3A) on which the sheets are stacked. A cassette opening/closing sensor 201 is further arranged on the back side of the sheet feeding cassette 409 serving as a storage unit. The cassette opening/closing sensor 201 detects an open/closed state of the sheet feeding cassette 409. The sheet presence/absence detection mechanism 91, the sheet feeding mechanism 71, and the cassette opening/closing sensor 201 will be described in detail below. Similarly to the sheet feeding device 61, the sheet feeding device 62 includes a sheet presence/absence detection mechanism 92, a sheet feeding mechanism 72, a pickup sensor 152, a lifter plate 412, and a cassette opening/closing sensor 202. The sheet feeding devices 61 and 62 make similar operations based on instructions from a control device (not illustrated). The following description will be given on the assumption that the sheet feeding device 61 is selected.

The sheet feeding mechanism 71 feeds a sheet stacked on the sheet feeding cassette 409 from the sheet feeding cassette 409 to a conveyance roller 154 in time with image formation timing of the process unit 120. The pickup sensor 151 detects whether a sheet has actually successfully been fed. The sheet is conveyed to the second transfer unit 140 via the conveyance roller 154, a conveyance roller 155, and a registration roller 161. A registration sensor 160 is a sensor for detecting the conveyed sheet. The registration sensor 160 detects the position of the sheet conveyed by the conveyance roller 155. Based on timing when a leading edge of the sheet reaches the registration sensor 160, the conveyance of the sheet is controlled so that the toner images on the transfer belt 130 are transferred to a predetermined position of the sheet. For example, suppose that the sheet is expected to reach the secondary transfer unit 140 earlier than the toner images on the transfer belt 130. In such a case, the registration roller 161 stops the sheet for a predetermined time and then resumes the conveyance. A transfer voltage is then applied to the secondary transfer unit 140 to transfer the toner images on the transfer belt 130 onto the sheet.

The sheet on which the toner images are transferred is conveyed to a fixing unit 170. The fixing unit 170 performs heating and pressurizing processing on the toner images on the sheet, whereby the toner images are fixed to the sheet. The sheet is then conveyed to the downstream side of the conveyance path. When the leading edge of the sheet that has passed through the fixing unit 170 reaches a sheet sensor 171, a conveyance flapper 172 is switched according to a print condition. This switches the conveyance destination of the sheet, and the sheet is conveyed to a conveyance path 230 or a conveyance path 231. More specifically, if printing the front side of the sheet in two-sided printing is finished, the sheet is conveyed to the conveyance path 230 to print the back side thereof. In the case of one-sided printing or if printing the back side in two-sided printing is finished, the sheet is conveyed to the conveyance path 231.

An operation after the sheet is conveyed to the conveyance path 231 will be described below. The sheet conveyed to the conveyance path 231 is further conveyed downstream of the conveyance path 231 by a conveyance roller 232. According to a sheet discharge condition specified in advance, a conveyance flapper 190 can switch whether to convey the sheet to a conveyance path 180 or a conveyance path 181. If the sheet discharge destination specified by the user is a sheet discharge tray 200, the sheet is conveyed to the conveyance path 180. If the sheet discharge destination is a sheet discharge tray 196, the sheet is conveyed to the conveyance path 181.

<System Configuration of Image Forming Apparatus>

Figure 2:
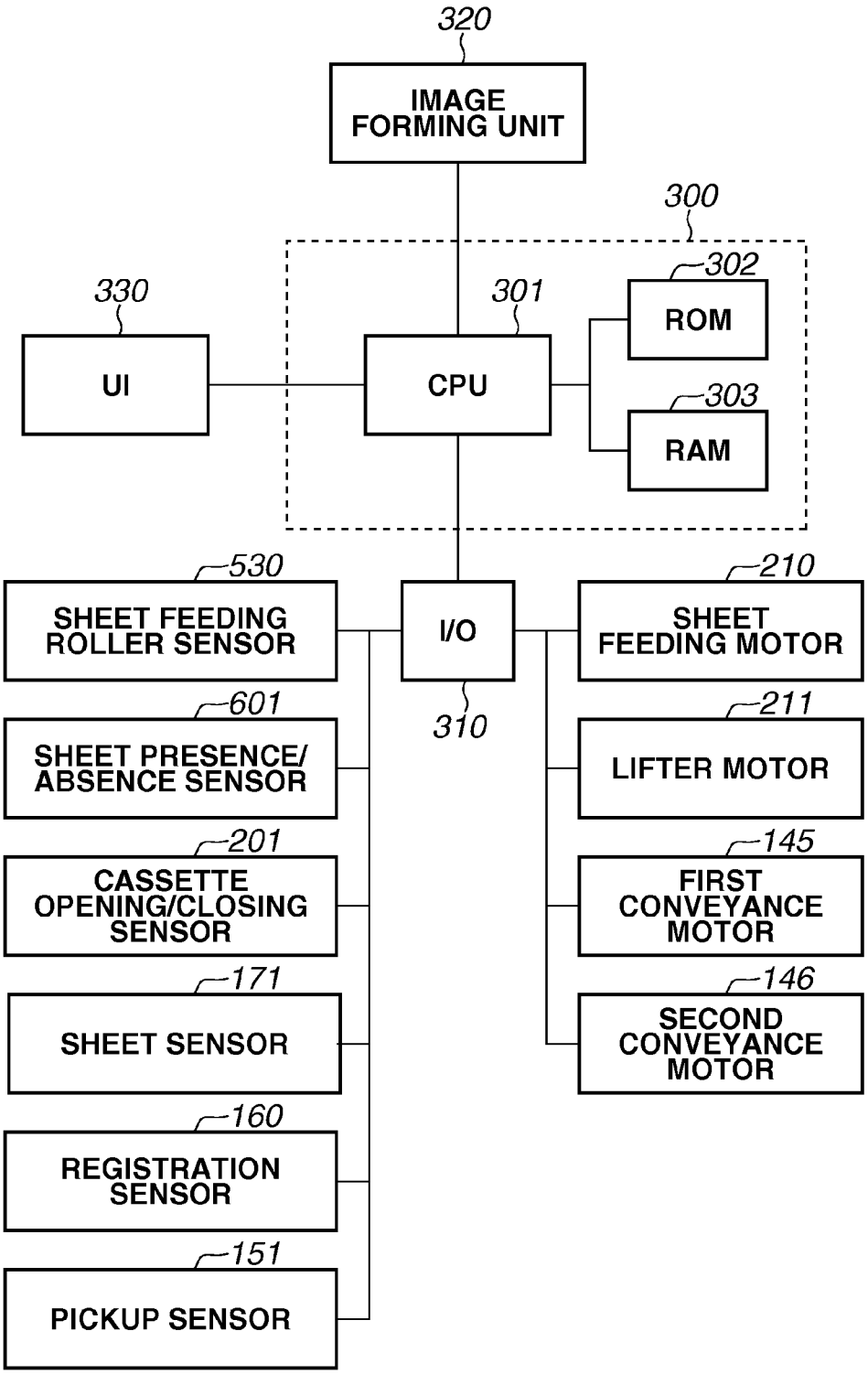
FIG. 2 is a control block diagram of the image forming apparatus.

FIG. 2 is a block diagram illustrating an overview of a system configuration of the image forming apparatus according to the present exemplary embodiment. While the sensors and motors of the sheet feeding device 61 are illustrated in FIG. 2, those of the sheet feeding device 62 are omitted. In FIG. 2, an image forming unit 320 refers to the configuration illustrated in FIG. 1 excluding the conveyance system. More specifically, the process unit 120, the laser scanner unit 122, the developer unit 110, the primary transfer unit 121, the transfer belt 130, the secondary transfer unit 140, and the fixing unit 170 correspond to the image forming unit 320. An operation of the image forming unit 320 is controlled by a control unit 300.

The control unit 300 (enclosed in a broken-line) includes a central processing unit (CPU) 301, a read-only memory (ROM) 302, and a random access memory (RAM) 303. The ROM 302 stores a control program and data for performing image formation and sheet feed processing. The RAM 303 is a memory used to temporarily store information when the CPU 301 executes the control program. The CPU 301 functions as a control unit based on the control program stored in the ROM 302 and detection information of various sensors. The various sensors include the pickup sensor 151, the registration sensor 160, and the sheet sensor 171 which are connected to the CPU 301 via an input/output (I/O) interface (denoted as I/O in FIG. 2) 310. The CPU 301 is also connected to a user interface (UI) 330 which provides the user with an operation environment (for example, an operation panel for inputting an operation start instruction and providing a display).

The control unit 300 (CPU 301) is connected to various motors and various sensors via the I/O interface 310 (hereinafter, abbreviated as the IO 310). The various motors include a first conveyance motor 145 and a second conveyance motor 146 for driving the conveyance system, a sheet feeding motor 210 for driving the sheet feeding mechanism 71 illustrated in FIG. 1 to feed and convey sheets, and a lifter motor 211 for driving the lifter plate 411. The first conveyance motor 145 is a motor for driving the sheet conveyance system rollers located upstream of the fixing unit 170, including the registration roller 161 and the conveyance rollers 154 and 155 illustrated in FIG. 1. The second conveyance motor 146 is a motor for driving the sheet conveyance system rollers located downstream of the fixing unit 170, including the conveyance roller 232.

The various sensors include the cassette opening/closing sensor 201, a sheet presence/absence sensor 601, and a sheet feeding roller sensor 530 aside from the pickup sensor 151, the registration sensor 160, and the sheet sensor 171 which are mentioned above. The cassette opening/closing sensor 201 is a sensor for detecting whether the sheet feeding cassette 409 is pulled out. The sheet presence/absence sensor 601 is a sensor for detecting the presence or absence of sheets stacked on the tray 410 (see FIG. 3A). The sheet feeding roller sensor 530 is a sensor for detecting whether the sheet (topmost sheet) at the top of the sheets stacked on the tray 410 has reached a position where a predetermined press-contact force is applied by the sheet feeding roller 401.

An image forming operation of when the reader 100 reads an image has been described above. An instruction to start a print operation may be input, for example, from the UI 330 or an external apparatus. Even in such cases, the CPU 301 issues an instruction for image formation to the image forming unit 320 and causes the sheet feeding device 61 to start a sheet feeding operation, whereby the foregoing image forming operation is performed.

<Configuration of Sheet Feeding Devices>

Next, the sheet feeding mechanism 71 and the sheet presence/absence detection mechanism 91 in the sheet feeding device 61 illustrated in FIG. 1, and elevation control of a sheet stacking tray in the sheet feeding device 61 will be described. As mentioned above, the sheet feeding devices 61 and 62 have similar configurations. The following description will thus be given by using the sheet feeding device 61 as an example.

(Sheet Feeding Mechanism)

Figure 3A:
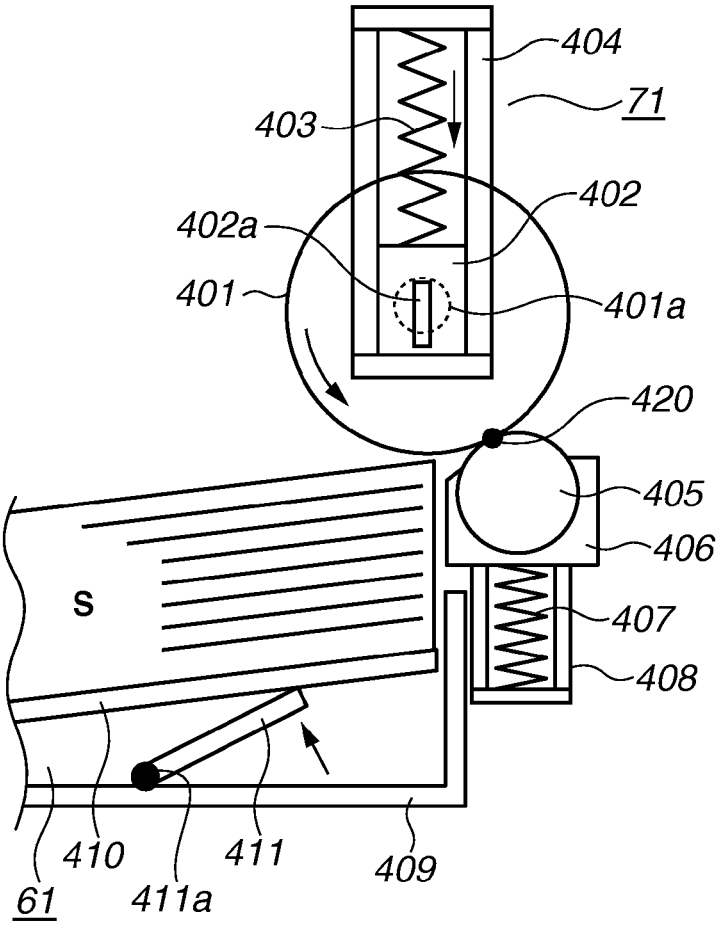
FIGS. 3A and 3B are diagrams illustrating a sheet feeding mechanism and a sheet feeding roller position detection mechanism, respectively.
Figure 3B:
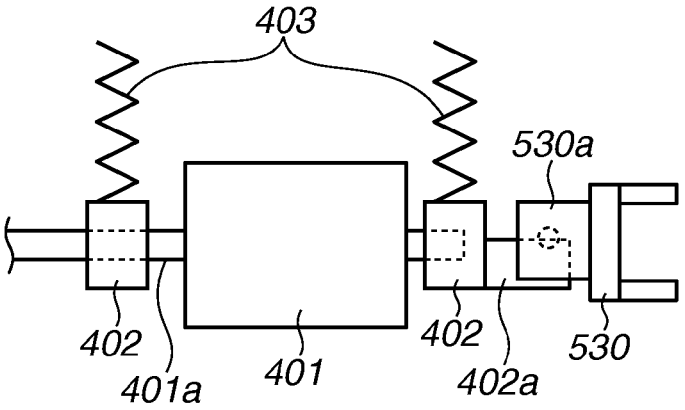

A configuration of the sheet feeding mechanism 71 illustrated in FIG. 1 will be described. FIG. 3A is a schematic diagram illustrating the configuration of the sheet feeding mechanism 71. FIG. 3B is a diagram illustrating a sheet feeding roller position detection mechanism. In FIG. 3A, the sheet feeding roller 401 includes a sheet feeding roller shaft 401*a* which is driven to rotate by the sheet feeding motor 210. The sheet feeding roller shaft 401*a* is rotatably supported by sheet feeding roller bearings 402. The sheet feeding roller bearings 402 are guided and supported by a sheet feeding roller regulation guide 404 in a vertically movable (elevatable) manner. As a result, the sheet feeding roller 401 is also configured to be vertically linearly movable. The sheet feeding roller bearings 402 are pressed in the direction of the arrow illustrated in FIG. 3A (downward direction) by sheet feeding roller pressing springs 403 which are arranged in the sheet feeding roller regulation guide 404. As a result, the sheet feeding roller 401 is also biased in the downward direction in FIG. 3A, i.e., toward a separation roller 405. A protrusion 402*a* is formed on one of the sheet feeding roller bearings 402. As the sheet feeding roller 401 moves, the protrusion 402*a* slides vertically together with the sheet feeding roller 401. According to the position of the sheet feeding roller 401, the protrusion 402*a* changes an ON/OFF state of the sheet feeding roller sensor 530 (illustrated in FIG. 3B). The sheet feeding roller sensor 530 will be described in detail below. As illustrated in FIG. 3B, the sheet feeding roller bearings 402 are arranged on both sides of the sheet feeding roller 401. The sheet feeding roller bearings 402 are biased in the downward direction in FIG. 3B by the sheet feeding roller pressing springs 403.

In FIG. 3A, the separation roller 405 arranged below the sheet feeding roller 401 includes a separation roller shaft (not illustrated). The separation roller shaft (not illustrated) is fixed to a separation guide 406. A torque limiter (not illustrated) is arranged between the separation roller 405 and the separation roller shaft (not illustrated). The separation guide 406 is regulated and supported by a separation roller regulation guide 408 to be linearly slidable in a vertical direction. As a result, the separation roller 405 fixed to the separation guide 406 is also configured to be linearly slidable in the vertical direction. The separation guide 406 is biased upward by a separation roller pressing spring 407. As a result, the separation roller 405 is brought into press contact with the sheet feeding roller 401 to form a separation nip portion 420 between the separation roller 405 and the sheet feeding roller 401. The elastic force of the sheet feeding roller pressing springs 403 is set to be greater than that of the separation roller pressing spring 407.

The separation roller 405 is driven to rotate as the sheet feeding roller 401 rotates. If only a single sheet S is fed into the separation nip portion 420, the separation roller 405 is driven to rotate by the movement of the sheet S. If two or more sheets are fed into the separation nip portion 420, the separation roller 405 stops being driven to rotate by the action of the torque limiter. As a result, only the sheet S making sliding contact with the sheet feeding roller 401 is fed out, while the other sheet(s) is/are stopped at the separation nip portion 420 by the separation roller 405. While the present exemplary embodiment uses the separation roller 405 that includes the torque limiter, a separation unit using a friction pad may be used instead of such a configuration.

(Elevation Control of Tray)

Next, a configuration for lifting up the tray 410 included in the sheet feeding cassette 409 of the sheet feeding device 61 will be described with reference to FIG. 3A. The sheet feeding cassette 409, which can be inserted into and removed from the image forming apparatus, includes the tray 410 for stacking the sheets S thereon and the lifter plate 411 for lifting and lowering the tray 410. The lifter plate 411 is rotatable in the direction of an arrow illustrated in FIG. 3A about a rotation center 411*a* by the lifter motor 211 (illustrated in FIG. 2) and a drive gear (not illustrated). As the lifter plate 411 rotates in the direction of the arrow, the downstream end of the tray 410 in the sheet feeding direction ascends toward the sheet feeding roller 401. As illustrated in FIG. 3A, the sheet feeding roller 401 is arranged above the tray 410 so that the sheet feeding roller 401 makes contact with the tray 410 when the downstream end of the tray 410 is lifted up. The lift-up operation for lifting up the tray 410 will be described below.

The tray 410 descends when the sheet feeding cassette 409 is pulled out of the image forming apparatus. More specifically, when the sheet feeding cassette 409 is pulled out of the image forming apparatus, the lifter motor 211 and the drive gear (not illustrated) are uncoupled from each other. The lifter plate 411 rotates in a direction opposite to the direction of the arrow illustrated in FIG. 3A about the rotation center 411*a*, and the end of the tray 410 on the side of the sheet feeding roller 401 descends. In the present exemplary embodiment, the tray 410 is configured not to be able to be lowered by the driving of the lifter motor 211.

(Sheet Feeding Roller Position Detection Mechanism)

Next, the sheet feeding roller position detection mechanism will be described with reference to FIG. 3B. FIG. 3B is a diagram illustrating a positional relationship between the sheet feeding roller 401, the sheet feeding roller bearings 402, the protrusion 402*a*, and the sheet feeding roller sensor 530. When the tray 410 is lifted up by the lifter plate 411, the sheet at the top of the sheets stacked on the tray 410 comes into contact with the sheet feeding roller 401, and the sheet feeding roller 401 moves in the upward direction in FIG. 3B. The protrusion 402*a* serving as a first sensor flag arranged on the sheet feeding roller bearing 402 moves upward together with the sheet feeding roller 401 accordingly. The sheet feeding roller sensor 530 includes a detection unit 530*a* which serves as a first sensor unit for detecting the position of the protrusion 402*a*. The detection unit 530*a* includes a light emitting unit and a light receiving unit on opposed walls of a gap portion for the protrusion 402*a* to pass. The light receiving unit detects that a light beam from the light emitting unit is shielded by the protrusion 402*a*, based on which the sheet feeding roller sensor 530 detects the position of the sheet feeding roller 401. The tray 410 ascends to a position (height) where a predetermined pressing force is applied to the sheet by the sheet feeding roller 401. As the tray 410 ascends, the protrusion 402*a* ascends together with the tray 410 and the detection unit 530*a* detects the protrusion 402*a*. In such a manner, the sheet feeding roller sensor 530 detects the height of the topmost sheet stacked on the tray 410 by detecting the position of the sheet feeding roller 401. If a detection signal is input from the sheet feeding roller sensor 530, the CPU 301 stops driving the lifter motor 211. The elastic force of the sheet feeding roller pressing springs 403 is set to be greater than that of the separation roller pressing spring 407. Consequently, as the sheets S are fed in succession and the position of the topmost sheet on the tray 410 lowers, the sheet feeding roller 401 descends pressing down the separation roller 405.

(Sheet Presence/Absence Detection Mechanism)

Figure 4A:
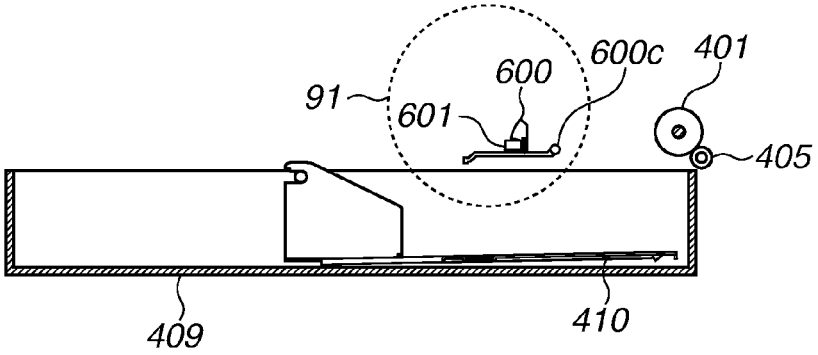
FIGS. 4A, 4B, 4C, and 4D are diagrams each illustrating a sheet presence/absence sensor.
Figure 4B:
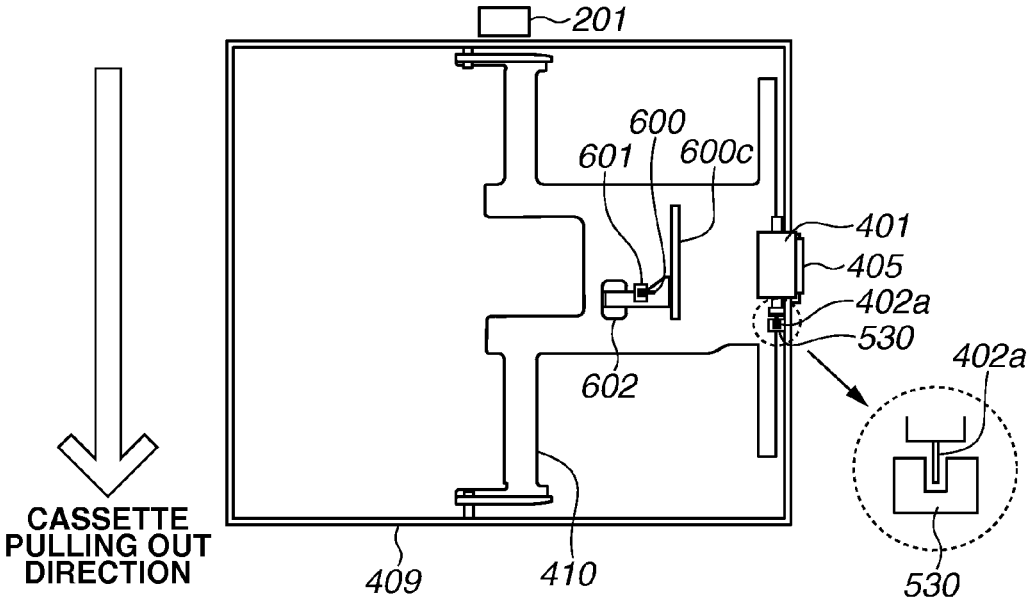

Next, a configuration of the sheet presence/absence detection mechanism 91 illustrated in FIG. 1 will be described with reference to FIGS. 4A to 4D. FIG. 4A is a schematic diagram illustrating the sheet feeding device 61 as viewed from a direction in which the sheet feeding cassette 409 is pulled out. FIG. 4B is a schematic diagram illustrating the sheet feeding device 61 as viewed from above the sheet feeding cassette 409. As illustrated in FIGS. 4A and 4B, the sheet feeding roller 401 and the separation roller 405 described above are arranged on the upper right side of the sheet feeding cassette 409 in FIG. 4A and on the right side thereof in FIG. 4B. An enlarged view of the sheet feeding roller sensor 530 and the protrusion 402*a* viewed from above the sheet feeding roller 401 is illustrated at the bottom right of FIG. 4B. As illustrated in the enlarged view, the protrusion 402*a* passes the gap portion of the sheet feeding roller sensor 530, based on which the position of the sheet feeding roller 401 is detected.

As illustrated in FIG. 4A, the sheet presence/absence detection mechanism 91 includes a sheet detection flag 600 serving as a second sensor flag and the sheet presence/absence sensor 601 serving as a second sensor unit. The sheet presence/absence detection mechanism 91 is arranged on the upstream side of the sheet feeding roller 401 in the sheet conveyance direction. As illustrated in FIG. 4B, the sheet presence/absence sensor 601 detects the stacking of sheets on the tray 410 based on that the sheet detection flag 600 passes a gap portion of the sheet presence/absence sensor 601, similarly to the sheet feeding roller sensor 530. The sheet detection flag 600 is supported by detection flag bearings (not illustrated) that rotatably support a detection flag shaft 600*c*. The sheet presence/absence sensor 601 is arranged near the sheet detection flag shaft 600*c*. A notch 602, which is a hole portion, is formed in the center portion of the tray 410.

Figure 4C:
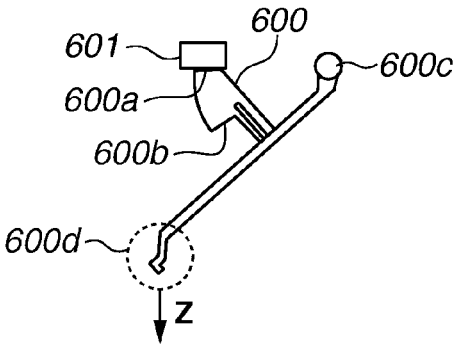
Figure 4D:
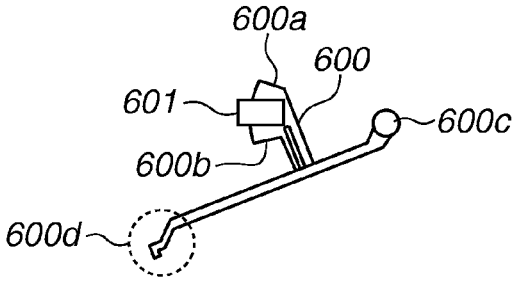

FIGS. 4C and 4D are diagrams each illustrating a positional relationship between the sheet detection flag 600 and the sheet presence/absence sensor 601 when the lift-up operation is completed. FIG. 4C illustrates the positional relationship between the sheet detection flag 600 and the sheet presence/absence sensor 601 when there is no sheet stacked on the tray 410. FIG. 4D illustrates the positional relationship between the sheet detection flag 600 and the sheet presence/absence sensor 601 when there is a sheet or sheets stacked on the tray 410. As illustrated in FIG. 4C, a tail portion 600*d* of the sheet detection flag 600 hangs down in a Z direction (vertical direction) by its own weight. The tail portion 600*d* of the sheet detection flag 600 is configured so that if there is no sheet in the sheet feeding cassette 409, the tail portion 600*d* sinks into the notch (opening portion) 602 (illustrated in FIG. 4B) even when the tray 410 is lifted up. In such a case, the sheet detection flag 600 is in the state illustrated in FIG. 4C, where a top end 600*a* of the sheet detection flag 600 does not reach the sheet presence/absence sensor 601 and is positioned not to block (shield) the optical axis of the sheet presence/absence sensor 601. Consequently, if the sheet presence/absence sensor 601 detects light even after the completion of the lift-up of the tray 410, the CPU 301 determines that there is no sheet stacked on the sheet feeding cassette 409. The CPU 301 then causes the UI 330 to display a message indicating the absence of sheets.

On the other hand, if there is a sheet or sheets on the tray 410 in the sheet feeding cassette 409 and the tray 410 is lifted up by the lifter plate 411, the sheet detection flag 600 enters the state illustrated in FIG. 4D. In such a case, the tail portion 600*d* of the sheet detection flag 600 is pushed up by the sheet(s) on the tray 410 as the tray 410 ascends. An intermediate portion between the top end 600*a* and a rear end 600*b* of the sheet detection flag 600 reaches the sheet presence/absence sensor 601, and the optical axis of the sheet presence/absence sensor 601 is shielded by the sheet detection flag 600. If the sheet presence/absence sensor 601 does not detect light, the CPU 301 determines that there is a sheet or sheets in the sheet feeding cassette 409. The CPU 301 then causes the UI 330 to display a message indicating the presence of a sheet(s).

Suppose that sheets are fully stacked on the tray 410. In such a state, the rear end 600*b* of the sheet detection flag 600 remains in a position where the optical axis of the sheet presence/absence sensor 601 is blocked (shielded) even before the tray 410 is lifted up. The rear end 600*b* of the sheet detection flag 600 never passes over the sheet presence/absence sensor 601. If fewer sheets than the fully stacked sheets are stacked on the tray 410 when the tray 410 ascends, the sheet presence/absence center 601 detects the presence of the sheets in the process of ascending. The sheet feeding roller sensor 530 then detects that the topmost sheet on the tray 410 has reached the position (height) where a predetermined pressing force is applied to the sheet by the sheet feeding roller 401. In the present exemplary embodiment, when the sheet feeding cassette 409 is inserted into the image forming apparatus with sheets fully stacked on the tray 410, the sheet presence/absence sensor 601 detects the presence of the sheets and the sheet feeding roller sensor 530 also detects that the sheet feeding roller 401 has reached a predetermined height.

(Cassette Opening/Closing Detection Mechanism)

Next, a configuration of the cassette opening/closing detection mechanism of the sheet feeding device 61 will be described with reference to FIG. 4B. The cassette opening/closing sensor 201 for detecting the state of the sheet feeding cassette 409 is arranged in a position opposite to the rear side of the center portion of the sheet feeding cassette 409 when viewed from a cassette pulling out direction of the sheet feeding cassette 409. The cassette opening/closing sensor 201 includes a protruding portion (not illustrated) facing the sheet feeding cassette 409. If the sheet feeding cassette 409 is inserted, the protruding portion (not illustrated) is pushed in by the sheet feeding cassette 409. If the sheet feeding cassette 409 is pulled out, the protruding portion (not illustrated) protrudes. The cassette opening/closing sensor 201 detects the open/closed state of the sheet feeding cassette 409 according to the state of the protruding portion (not illustrated).

<Lift-Up Control of Tray of Sheet Feeding Cassette>

Figure 5:
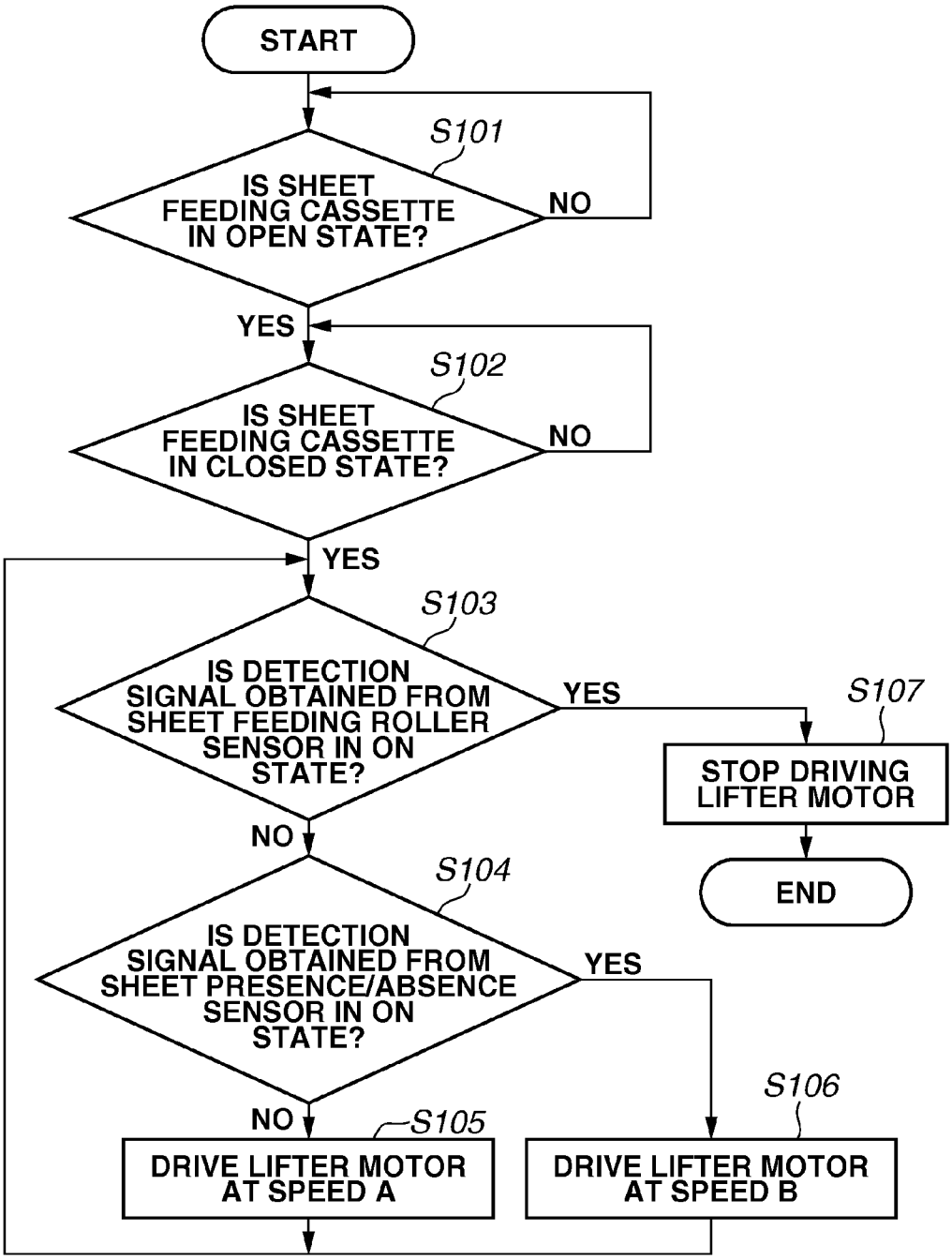
FIG. 5 is a flowchart illustrating lift-up control of a tray.

Next, a sheet lift-up operation for lifting up the end of the tray 410 with the lifter plate 411 to bring the sheets stacked on the tray 410 into press contact with the sheet feeding roller 401 will be described with reference to FIG. 5. FIG. 5 is a flowchart illustrating a processing sequence of sheet lift-up processing. The sheet lift-up processing illustrated in FIG. 5 is performed by the CPU 301 based on the control program stored in the ROM 302 of the control unit 300.

The sheet lift-up processing is performed, for example, when the sheet feeding cassette 409 pulled out of the image forming apparatus for sheet replenishment is returned (inserted again) to the image forming apparatus. In step S101, the CPU 301 determines whether the sheet feeding cassette 409 is pulled out of the image forming apparatus. More specifically, the CPU 301 obtains a detection signal indicating the open/closed state of the sheet feeding cassette 409 from the cassette opening/closing sensor 201 via the IO 310, and determines whether the sheet feeding cassette 409 is in a pulled-out state, i.e., an open state. If the cassette opening/closing sensor 201 detects that the sheet feeding cassette 409 is in the pulled-out (open) state, the cassette opening/closing sensor 201 changes the detection signal output to the CPU 301 to an OFF state. If the cassette opening/closing sensor 201 detects that the sheet feeding cassette 409 is in an inserted (closed) state, the cassette opening/closing sensor 201 changes the detection signal to an ON state. If the CPU 301 determines based on the detection signal obtained from the cassette opening/closing sensor 201 that the sheet feeding cassette 409 is in the open state (YES in step S101), the processing proceeds to step S102. If the CPU 301 determines that the sheet feeding cassette 409 is in the inserted state, i.e., closed state (NO in step S101), the CPU 301 repeats the processing of step S101. In step S102, the CPU 301 determines whether the sheet feeding cassette 409 has been inserted into the image forming apparatus. For that purpose, the CPU 301 obtains the detection signal indicating the open/closed state of the sheet feeding cassette 409 from the cassette opening/closing sensor 201 via the IO 310, and determines whether the sheet feeding cassette 409 is in the closed state. If the CPU 301 determines that the sheet feeding cassette 409 is in the closed state (YES in step S102), the processing proceeds to step S103. If the CPU 301 determines that the sheet feeding cassette 409 is in the open state (NO in step S102), the CPU 301 repeats the processing of step S102.

In step S103, the CPU 301 obtains a detection signal indicating a positional state of the sheet feeding roller 401 from the sheet feeding roller sensor 530 via the IO 310. The CPU 301 then determines whether the sheet at the top surface of the sheet bundle stacked on the tray 410 has reached the position (height) where the sheet is brought into press contact with the sheet feeding roller 401 with a predetermined pressure. As described above, the end of the tray 410 is lifted up by the lifter plate 411, and the sheets stacked on the tray 410 ascend accordingly. The sheet at the top surface of the sheet bundle stacked on the tray 410 then comes into contact with the sheet feeding roller 401. As the tray 410 ascends, the sheet feeding roller 401 is pushed up and the protrusion 402*a* is also pushed up. As a result, the sheet feeding roller sensor 530 detects the protrusion 402*a* and changes the detection signal output to the CPU 301 from the OFF state to the ON state. The CPU 301 determines whether the detection signal obtained from the sheet feeding roller sensor 530 is in the ON state. If the detection signal is determined to be in the ON state (YES in step S103), the processing proceeds to step S107. If the detection signal is determined to be in the OFF state (NO in step S104), the processing proceeds to step S104.

In step S104, the CPU 301 obtains a detection signal indicating the presence or absence of a sheet from the sheet presence/absence sensor 601 via the IO 310 to determine whether there is a sheet or sheets on the tray 410. If the sheet presence/absence sensor 601 detects that there is a sheet or sheets on the tray 410, the sheet presence/absence sensor 601 changes the detection signal output to the CPU 301 to an ON state. If the sheet presence/absence sensor 601 does not detect that there is a sheet or sheets on the tray 410, the sheet presence/absence sensor 601 changes the detection signal to an OFF state. The CPU 301 determines whether the detection signal obtained from the sheet presence/absence sensor 601 is in the ON state. If the detection signal is determined to be in the ON state (YES in step S104), the processing proceeds to step S106. If the detection signal is determined to be in the OFF state (NO in step S104), the processing proceeds to step S105.

In step S105, the CPU 301 performs control to drive the lifter motor 211 at speed A via the IO 310, and the processing returns to step S103. Speed A of the lifer motor 211 is higher than speed B to be described below. Driving the lifter motor 211 lifts up the tray 410 and the sheets stacked on the tray 410 via the lifter plate 411. In step S106, the CPU 301 performs control to drive the lifter motor 211 via the IO 310 at speed B which is a driving speed lower than speed A, and the processing returns to step S103. The CPU 301 performs the processing of step S106 in the following case. By performing the processing of step S105, the lifter motor 211 is driven to lift up the sheets stacked on the tray 410 via the lifter plate 411, and the sheet at the top surface pushes up the tail portion 600*d* of the sheet detection flag 600. As a result, the sheet presence/absence sensor 601 detects the sheet detection flag 600, and changes the detection signal output to the CPU 301 from the OFF state to the ON state. The CPU 301 performs the processing of step S106 in such a case.

In step S107, the CPU 301 stops driving the lifter motor 211 via the IO 310 since the sheet at the top surface of the sheet bundle stacked on the tray 410 has reached the position where the predetermined pressing force is applied to the sheet by the sheet feeding roller 401. The ON state and the OFF state of the sheet feeding roller sensor 530 described above may be configured so that the ON state is changed to the OFF state when the protrusion 402*a* is detected. Similarly, the sheet presence/absence sensor 601 may be configured so that the ON state is changed to the OFF state when the sheet detection flag 600 is detected.

An operation of the CPU 301 when there is no sheet on the tray 410 of the sheet feeding cassette 409 will be described with reference to FIG. 5. The processing of steps S101 to S105 is the same as those described above. A description thereof will thus be omitted. After driving the lifter motor 211 at speed A in step S105, the CPU 301 monitors the detection signal of the sheet feeding roller sensor 530 for a change from the OFF state to the ON state. If there is no sheet on the tray 410, the sheet presence/absence sensor 601 remains in the OFF state. The lifter motor 211 therefore continues to be driven at speed A until the end of the tray 410 pushes up the sheet feeding roller 401 and the sheet feeding roller sensor 530 enters the ON state. In step S103, if the CPU 301 detects that the detection signal of the sheet feeding roller sensor 530 has changed to the ON state (YES in step S103), then in step S107, the CPU 301 stops driving the lifter motor 211 to complete the lift-up operation.

Next, an operation of the CPU 301 will be additionally described for a case where the detection signal of the sheet feeding roller sensor 530 is in the ON state when the cassette opening/closing sensor 201 detects the closed state while sheets are fully stacked on the tray 410. Immediately after the closed state of the sheet feeding cassette 409 is detected in step S102 (YES in step S102), then in step S103, the CPU 301 detects that the detection signal from the sheet feeding roller sensor 530 is in the ON state (YES in step S103). In such a case, in step S107, the CPU 301 stops the lift-up operation of the tray 410 without driving the lifter motor 211. If the sheet feeding roller sensor 530 is configured to enter the ON state when sheets are fully stacked in the sheet feeding cassette 409, the lift-up operation is completed without driving the lifter motor 211.

<Timing Charts of Lift-Up Operation of Tray of Sheet Feeding Cassette>

Figure 6A:
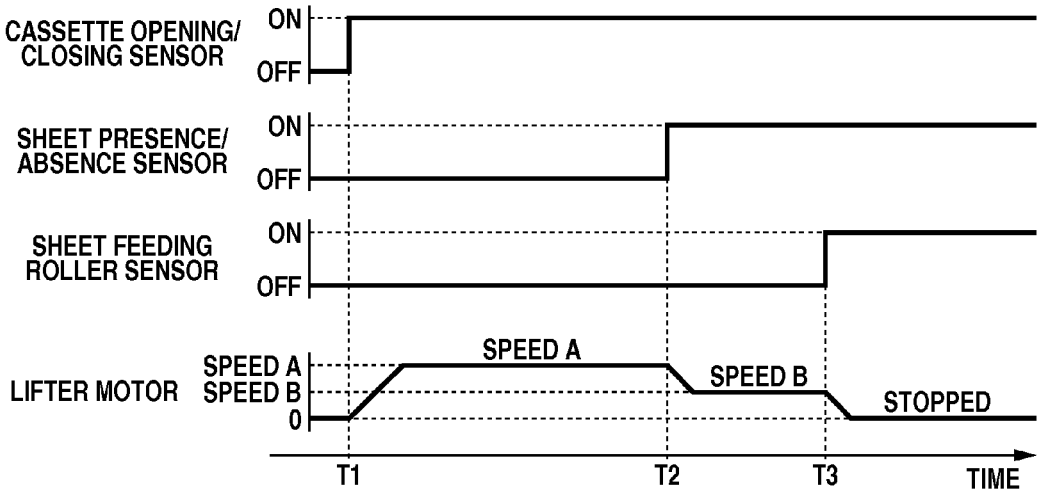
FIGS. 6A and 6B are timing charts each illustrating the lift-up control of the tray.
Figure 6B:
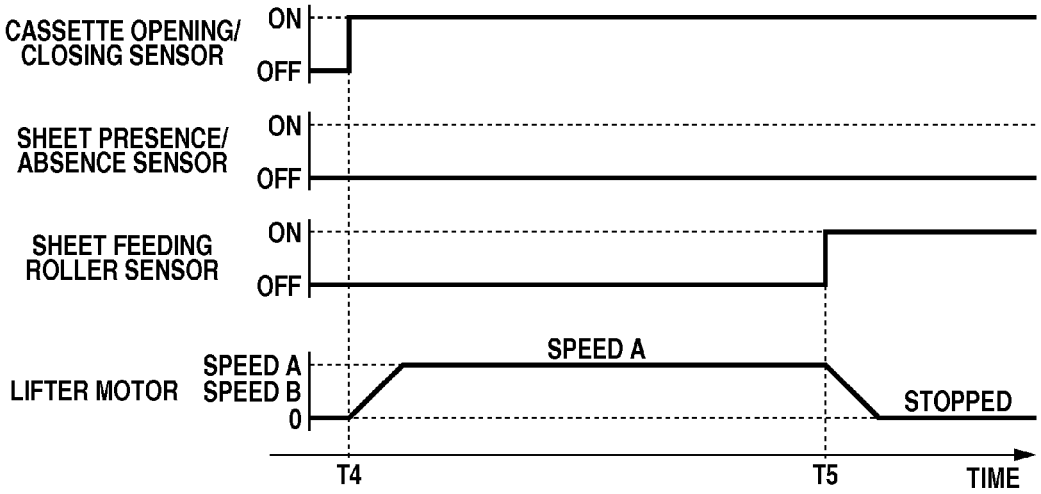

Next, the lift-up operation described with reference to the flowchart of FIG. 5 will be additionally described by using timing charts. FIG. 6A is a timing chart of the lift-up operation when there is a sheet or sheets on the tray 410 of the sheet feeding cassette 409. FIG. 6B is a timing chart of the lift-up operation when there is no sheet on the tray 410 of the sheet feeding cassette 409. FIG. 6A is a graph illustrating, in order from the top, the ON/OFF states of the detection signals output to the CPU 301 from the cassette opening/closing sensor 201, the sheet presence/absence sensor 601, and the sheet feeding roller sensor 530, and the driving speed of the lifter motor 211. In FIG. 6A, the ON states of the detection signals are denoted by "ON", and the OFF states of the detection signals by "OFF". "SPEED A", "SPEED B", and "0" for the lifter motor indicate the driving speeds of the lifter motor 211. Speed A is higher than speed B. The horizontal axis indicates time. T1, T2, and T3 represent respective points of timing.

(When a Sheet(s) is Placed on Tray 410 of Sheet Feeding Cassette 409)

In FIG. 6A, the CPU 301 detects that the detection signal of the cassette opening/closing sensor 201 changes from the OFF state to the ON state at time T1. The CPU 301 then starts control to drive the lifter motor 211 at speed A. After a predetermined time, the driving speed of the lifter motor 211 stabilizes at speed A. At time T2, the CPU 301 detects that the detection signal of the sheet presence/absence sensor 601 changes from the OFF state to the ON state. The CPU 301 then performs control to change the speed so that the driving speed of the lifter motor 211 becomes speed B. After a lapse of a predetermined time, the lifter motor 211 stabilizes at speed B. At time T3, the CPU 301 detects that the detection signal of the sheet feeding roller sensor 530 changes from the OFF state to the ON state. The CPU 301 then performs control to stop driving the lifter motor 211, whereby the lift-up operation is completed.

(When No Sheet is Placed on Tray 410 of Sheet Feeding Cassette 409)

FIG. 6B illustrates a timing chart of the lift-up operation when there is no sheet on the tray 410 of the sheet feeding cassette 409. FIG. 6B is a graph similar to FIG. 6A. A description of the graph expressions will thus be omitted. In FIG. 6B, T4 and T5 represent respective points of timing. In FIG. 6B, the CPU 301 detects that the detection signal of the cassette opening/closing sensor 201 changes from the OFF state to the ON state at time T4. The CPU 301 then drives the lifter motor at speed A. If there is no sheet on the tray 410, the detection signal of the sheet presence/absence sensor 601 remains in the OFF state until the detection signal of the sheet feeding roller sensor 530 changes from the OFF state to the ON state and the lift-up operation is completed. The lifter motor 211 therefore continues the lift-up operation at speed A until the detection signal of the sheet feeding roller sensor 530 changes to the ON state. At time T5, the CPU 301 detects that the detection signal of the sheet feeding roller sensor 530 changes to the ON state. The CPU 301 then performs control to stop driving the lifter motor 211, whereby the lift-up operation is completed.

As has been described above, according to the present exemplary embodiment, by using sensors that are originally provided for other purposes without providing a dedicated sensor for switching the lift-up speed, the lift-up time of the elevating tray can be reduced, and improved usability and stable sheet feeding operations can be achieved. In other words, the omission of the dedicated sensor for switching the lift-up speed can prevent an increase in cost. The lift-up speed can be increased without providing the dedicated sensor for switching the lift-up speed, thereby reducing the lift-up time of the tray and improving usability. The lift-up speed is appropriately switched to low speed at a position just before a position where a sheet makes contact with the sheet feeding roller 401. This can appropriately control the sheet feeding pressure between the sheet feeding roller 401 and the sheet to stabilize sheet feeding operations. If there is no sheet in the sheet feeding cassette 409, the lifter motor 211 is driven at high speed until the completion of the lift-up. This can reduce the time to complete the lift-up to achieve improved usability and stable sheet feeding operations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-003368 filed Jan. 10, 2014, which is hereby incorporated by reference herein in its entirety.

What is claimed is:

1. A sheet feeding device comprising:

a sheet storage unit having a tray on which a sheet bundle including a plurality of sheets is to be stacked;

a driving unit configured to lift up the tray;

a first detection unit configured to detect, at a predetermined position, a top surface of the sheet bundle stacked on the tray lifted up by the driving unit;

a second detection unit configured to detect whether a sheet is stacked on the tray;

a control unit configured to continuously drive the driving unit so that the tray is to be lifted up continuously in a first speed until the second detection unit detects the sheet while the first detection unit has not detected the top surface of the sheet bundle, and continuously drive the driving unit so that, after the second detection unit detects the sheet, the tray is to be lifted up continuously in a second speed that is slower than the first speed; and a display unit configured to display, if the second detection unit detects that no sheet is stacked on the tray, a message indicating that there is no sheet on the tray.

2. The sheet feeding device according to claim 1, wherein, if the first detection unit detects the top surface of the sheet bundle, the control unit is configured to control the driving unit to stop lifting up the tray regardless of a detection result by the second detection unit.

3. The sheet feeding device according to claim 1, further comprising a feeding roller configured to make contact with a sheet at the top surface of the sheet bundle to feed the sheet, wherein the predetermined position is a position at a height where the feeding roller feeds the sheet.

4. The sheet feeding device according to claim 3, wherein the feeding roller is configured to ascend by making contact with the sheet bundle on the tray lifted up by the driving unit, and wherein the first detection unit is configured to detect the top surface of the sheet bundle by detecting that the feeding roller ascends to a second predetermined position.

5. The sheet feeding device according to claim 1, wherein, if the sheet storage unit is in the open state with respect to the sheet feeding device, the tray is configured to descend regardless of driving of the driving unit.

6. A sheet feeding device comprising:

a sheet storage unit having a tray on which a sheet bundle including a plurality of sheets is to be stacked;

a driving unit configured to lift up the tray;

a first detection unit configured to detect, at a predetermined position, a top surface of the sheet bundle stacked on the tray lifted up by the driving unit;

a second detection unit configured to detect whether a sheet is stacked on the tray; and a control unit configured to continuously drive the driving unit so that the tray is to be lifted up continuously in a first speed until the second detection unit detects the sheet while the first detection unit has not detected the top surface of the sheet bundle, and continuously drive the driving unit so that, after the second detection unit detects the sheet, the tray is to be lifted up continuously in a second speed that is slower than the first speed, wherein the second detection unit includes a sensor configured to detect a flag member pushed up by the sheet stacked on the tray lifted up by the driving unit, and wherein the tray has an opening for keeping the flag member from contact with the tray when no sheet is stacked on the tray.

7. A sheet feeding device comprising:

a sheet storage unit having a tray on which a sheet bundle including a plurality of sheets is to be stacked;

a driving unit configured to lift up the tray;

a first detection unit configured to detect, at a predetermined position, a top surface of the sheet bundle stacked on the tray lifted up by the driving unit;

a second detection unit configured to detect whether a sheet is stacked on the tray;

a control unit configured to continuously drive the driving unit so that the tray is to be lifted up continuously in a first speed until the second detection unit detects the sheet while the first detection unit has not detected the top surface of the sheet bundle, and continuously drive the driving unit so that, after the second detection unit detects the sheet, the tray is to be lifted up continuously in a second speed that is slower than the first speed; and an opening/closing detection unit configured to detect whether the sheet storage unit is in an open state or a closed state with respect to the sheet feeding device, wherein, if the opening/closing detection unit detects that the sheet storage unit changes from the open state to the closed state, the control unit is configured to control the driving unit to lift up the tray, and wherein the control unit is configured not to operate the driving unit if the opening/closing detection unit detects that the sheet storage unit changes from the open state to the closed state, and the first detection unit also detects the top surface of the sheet bundle before the tray is lifted up by the driving unit.

8. An image forming apparatus comprising:

a sheet storage unit having a tray on which a sheet bundle including a plurality of sheets is to be stacked;

a driving unit configured to lift up the tray;

a first detection unit configured to detect, at a predetermined position, a top surface of the sheet bundle stacked on the tray lifted up by the driving unit;

a second detection unit configured to detect whether a sheet is stacked on the tray;

a feeding unit configured to feed a sheet at the top surface of the sheet bundle;

an image forming unit configured to form an image on the sheet fed by the feeding unit;

a control unit configured to continuously drive the driving unit so that the tray is to be lifted up continuously in a first speed until the second detection unit detects the sheet while the first detection unit has not detected the top surface of the sheet bundle, and continuously drive the driving unit so that the tray is to be lifted up continuously in a second speed that is slower than the first speed after the second detection unit detects the sheet; and a display unit configured to display, if the second detection unit detects that no sheet is stacked on the tray, a message indicating that there is no sheet on the tray.

9. A method for a sheet feeding device including a sheet storage unit having a tray on which a sheet bundle including a plurality of sheets is to be stacked, and including a driving unit configured to lift up the tray, the method comprising:

detecting, as a first detection and at a predetermined position, a top surface of the sheet bundle stacked on the tray lifted up by the driving unit;

detecting, as a second detection, whether a sheet is stacked on the tray;

continuously driving the driving unit so that the tray is to be lifted up continuously in a first speed until the second detection detects the sheet while the first detection has not detected the top surface of the sheet bundle, and continuously driving the driving unit so that, after the second detection detects the sheet, the tray is to be lifted up continuously in a second speed that is slower than the first speed; and displaying, if the second detection detects that no sheet is stacked on the tray, a message indicating that there is no sheet on the tray.

* * * * *